US007245075B2

(12) United States Patent
Chen et al.

(10) Patent No.: US 7,245,075 B2
(45) Date of Patent: Jul. 17, 2007

(54) DIMMABLE METAL HALIDE HID LAMP WITH GOOD COLOR CONSISTENCY

(75) Inventors: Nancy H. Chen, North Andover, MA (US); Joseph A. Olsen, Gloucester, MA (US)

(73) Assignee: Osram Sylvania Inc., Danvers, MA (US)

( * ) Notice: Subject to any disclaimer, the term of this patent is extended or adjusted under 35 U.S.C. 154(b) by 88 days.

(21) Appl. No.: 11/103,080

(22) Filed: Apr. 11, 2005

(65) Prior Publication Data

US 2006/0226776 A1 Oct. 12, 2006

(51) Int. Cl.
*H01J 17/20* (2006.01)
*H01J 61/12* (2006.01)

(52) U.S. Cl. ..... 313/576; 313/637; 313/643; 313/568; 313/570

(58) Field of Classification Search ..... 313/643, 313/571, 576, 570, 637, 568
See application file for complete search history.

(56) References Cited

U.S. PATENT DOCUMENTS 4,890,042 A * 12/1989 Witting ..... 313/642
6,404,129 B1 * 6/2002 Hendricx et al. ..... 313/620
6,495,962 B2 * 12/2002 Uemura et al. ..... 313/620
7,045,960 B2 * 5/2006 Gunter ..... 313/634
7,061,182 B2 * 6/2006 Higashi et al. ..... 313/637
7,138,766 B2 * 11/2006 Takeuchi et al. ..... 313/643
2004/0189212 A1 * 9/2004 Ashida et al. ..... 315/97
2005/0174053 A1 * 8/2005 Gunter ..... 313/567
2005/0179401 A1 * 8/2005 Stockwald ..... 315/209 R
2005/0248279 A1 * 11/2005 Lambrechts et al. ..... 313/640

* cited by examiner

*Primary Examiner*—Nimeshkumar D. Patel
*Assistant Examiner*—Peter Macchiarolo
(74) *Attorney, Agent, or Firm*—William E. Meyer

(57) ABSTRACT

Metal halide lighting with good color during dimming may be obtained. An appropriate balance of commonly used metal halides (NaI, $DyI_3$, $CeI_3$, $CaI_2$, TlI) is dosed in the lamp. No mercury is used. A higher than typical xenon fill pressure from 50 to 500 Kilopascals may be used to help control thermal properties and voltage. If necessary, modulation of the power at acoustic resonance frequencies may be used to straighten and center the arc. Efficient and pleasant white output is obtained. As the power is reduced, the chromaticity either (1) remains fairly constant or (2) drifts acceptably towards warm pinkish colors. Large factors of attenuation in output can be realized. The lumen output was reduced by at least a factor of twenty in one sample as the power was dimmed from 70 to 20 watts.

8 Claims, 2 Drawing Sheets

DIMMABLE METAL HALIDE HID LAMP WITH GOOD COLOR CONSISTENCY

BACKGROUND OF THE INVENTION

1. Field of the Invention

The invention relates to electric lamps and particularly to electric discharge lamps. More particularly the invention is concerned with dimmable, mercury free electric discharge lamps.

2. Description of the Related Art Including Information Disclosed Under 37 CFR 1.97 and 1.98

Commercially available metal halide discharge lighting is efficient and provides reasonably good color rendering and a pleasant white output at rated power. The typical lamp chemistry sealed in the arc tube contains combinations of metal halide salts to optimize the efficiency and color of the output, as well as mercury for obtaining proper voltage and thermal characteristics.

For energy savings, ambience enhancement, and other reasons it is desirable to dim the output of the lamp, as is readily done with incandescent lamps. However, as a typical metal halide lamp is dimmed, the cooler condensate temperatures result in a reduction in vapor pressure of the metal halides, which can affect the balance of individual metal halides causing drifts in the chromaticity in the light output. For example, atomic thallium emission, which is green, can become more evident. There is also often increased atomic mercury emission relative to other species, which can result in a further undesirable green contribution to the output. The depth of dimming may also be limited by lamp instabilities at low power. Though typical metal halide lamps can be dimmed to some extent for energy savings, the color is often poor. There is then a need for high intensity discharge lamps that can be dimmed and still provide consistent color throughout the dimming range.

There have been attempts to improve the dimming behavior of metal halide lamps. Lamp outer jackets can be coated with phosphors to convert mercury radiation to other wavelengths (McAllister in U.S. Pat. No. 4,229,673). Zhu and Maya, in U.S. Pat. No. 6,242,851, describe the use of heat shields to maintain the condensate at sufficiently elevated temperatures down to 50% of rated lamp wattage with a minimal change in color corrected temperature (CCT), although chromaticity data is not reported. Sakai, Okada, Higashisaka, and Hashimoto in U.S. Pat. No. 6,639,341, describe various methods of regulating the condensate temperature. Lambrechts and Maya, in U.S. Pat. No. 6,501,220, describe the use of thallium-free metal halide fills to avoid green emission during dimming from atomic thallium in the discharge.

Hendrix U.S. Pat. No. 6,404,129 discloses the use of high-pressure xenon fills. Spherical or near spherical (bulgy) shaped arc tubes (Sylvania Powerball®) have been disclosed in Lang U.S. Pat. No. 5,936,351. Olsen, Moskowitz, Newell, and Brates in U.S. Pat. No. 6,124,683 have described power modulation at acoustic resonance frequencies for the purpose of straightening arcs in cylindrical mercury-free lamps. References to other examples of acoustic straightening are given in that patent.

BRIEF SUMMARY OF THE INVENTION

An arc discharge lamp can be made that is dimmable with little or no change in the chromaticity. The lamp has a light transmissive envelope formed from ceramic. The envelope has a wall defining an enclosed volume. A first electrode assembly extends from the lamp exterior through the wall in a sealed fashion to be in contact with the enclosed volume. A second electrode assembly extends from the lamp exterior through the wall in a sealed fashion to be in contact with the enclosed volume. An inert fill gas is in enclosed volume with a cold fill pressure of from 50 Kilopascals to 500 Kilopascals. A fill material is in the enclosed volume and includes NaI, $CeI_3$, and $DyI_3$. The fill material does not include the elements mercury, indium, gallium, or zinc or compounds including these elements.

DETAILED DESCRIPTION OF THE INVENTION

Figure 1:
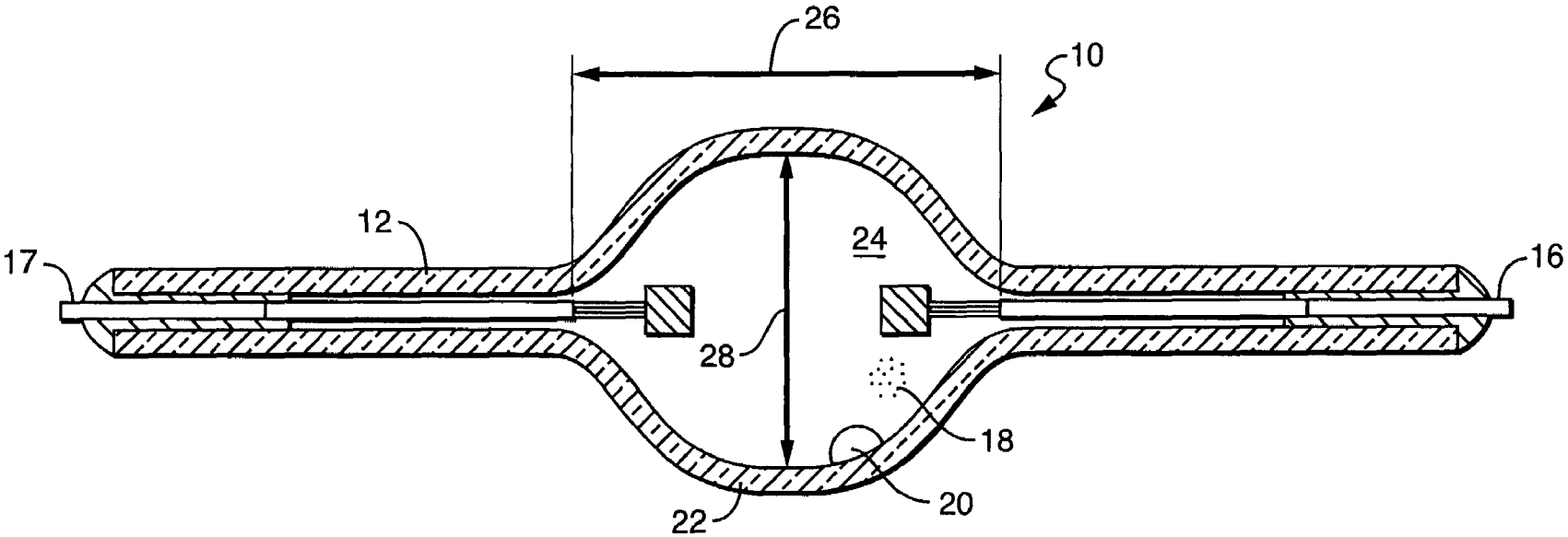
FIG. 1 shows a schematic cross-sectional view of a low aspect ratio arc discharge lamp.

FIG. 1 shows a schematic cross-sectional view of a low aspect ratio arc discharge lamp 10. The arc discharge lamp 10 includes a light transmissive envelope 12, a first electrode assembly 14, a second electrode assembly 16, an inert fill gas 18, and a fill material 20 excitable to light emission by the application of electric power supplied through the first and second electrodes.

The light transmissive envelope 12 may be any appropriate light transmissive material as known the art of lamp making. Quartz, sapphire, polycrystalline alumina (PCA) and similar envelope materials may be used depending in part on the preferred chemistry. The preferred envelope material is a light transmissive ceramic. The envelope includes a wall 22 that defines an enclosed volume 24. The enclosed volume 24 may have a ratio of the internal axial extension 26 to the internal diameter 28 (center point diameter) that may be one or greater. Some of the suggested fill formulations work better in high aspect ratio lamps where the ratio of internal length to diameter is greater than two, while others may work better in low aspect ratio lamps where the ratio is less than two.

The first electrode assembly 14 extends from the lamp exterior through the wall 22 in a sealed fashion to be in contact with the enclosed volume 24. A similar second electrode assembly 16 extends from the lamp exterior through the wall 22 in a sealed fashion to be in contact with the enclosed volume 24. The electrode assemblies 14, 16 may be any of the known designs used in arc discharge lamps. The preferred electrode consisted of a niobium outer section, a middle section comprising a molybdenum rod wrapped with a molybdenum coil that are then sealed to the PCA, and a tungsten rod inner section wrapped with a tungsten coil, as is known in the art. The electrodes assemblies 14, 16 are hermetically sealed to the envelope 12 to contain the fill gas 18 and the fill material 20.

The inert fill gas 18 is sealed in the enclosed volume 24, and may comprise any of the inert gases or mixtures there of. The preferred fill gas 18 is xenon with a cold fill pressure from 50 Kilopascals to 500 Kilopascals.

The fill material 20 is chosen to be excitable to light emission by the application of electric power supplied through the first electrode 14 and second electrode 16. There are numerous known HID fill materials. They generally include mercury and metal halides. Here the Applicants use no mercury and the other preferred metal halides and fill components are taken from the rare earth elements. In general, the more fill components included, the broader the spectrum the generated light has and therefore the better the color rendering, however, the more the fill components added, the more costly the manufacturing process. The Applicants have found that four or five components can give good color rendering and still provide a practical manufacturing process.

The fill material 20 includes a plurality of chemical components and each chemical component has a vapor pressure to temperature relation that is similar in slope to those of the remaining chemical components. During lamp dimming, the lamp operating temperature drops as less power is applied to it. The differing fill material components then condense with similar rates, substantially maintaining the same relative operating fill concentrations. Where there is a substantial similarity in the relative vapor pressures of the fill components, there is a relatively little change in the plasma composition, resulting in little or no color shift. The Applicants, in contrast to the common practice, formulate the fill composition so that all the components have similar or approximately equal vapor pressures throughout the operating temperature range. In this way, as the lamp is dimmed and run at a lower temperature, all of the fill materials condense at similar rates so the overall low power plasma composition is similar to the full power plasma composition. Balancing the fill component vapor pressures means all the traditional high vapor pressure components (mercury, thallium, indium, gallium, and zinc) are excluded from the fill material formulation. With all the fill materials having similar vapor pressures, the color temperature is then approximately the same during dimming. The Applicants have found instead of increasing the lamp color temperature, as the lamps are dimmed, the new lamps provide the same or slightly lower color temperatures during dimming. Some of Applicants' lamps provided approximately the same color during dimming.

Figure 2:
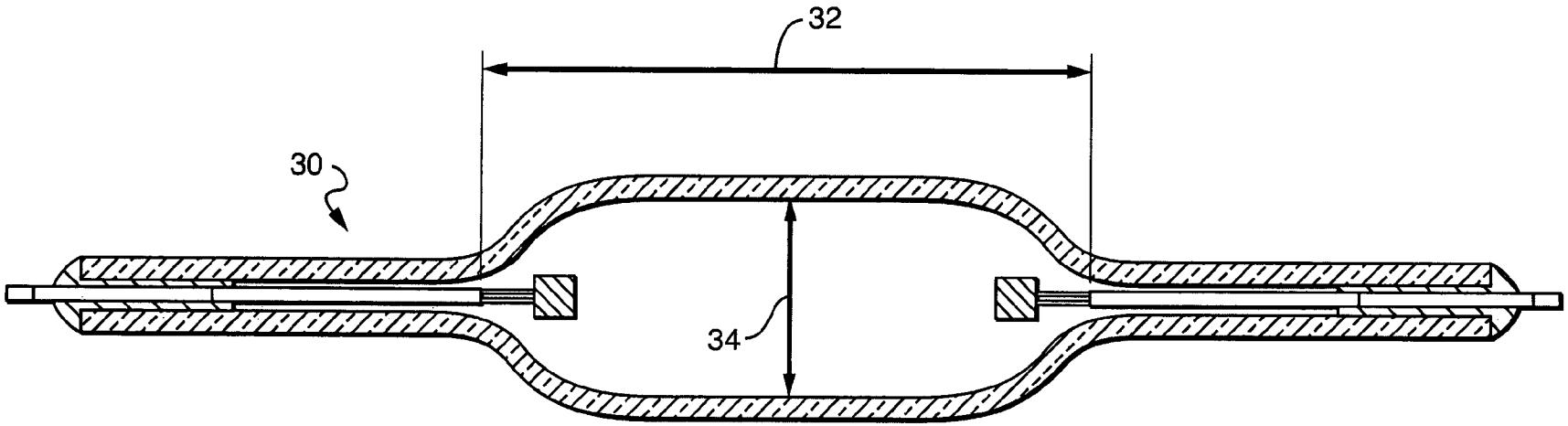
FIG. 2 shows a schematic cross-sectional view of a high aspect ratio arc discharge lamp.

FIG. 2 shows a schematic cross-sectional view of a high aspect ratio arc discharge lamp 30. The high aspect ratio lamp 30 has an internal axial extension 32 that is two or more times greater than the internal transverse diameter 34 through the center point.

To avoid undesirable mercury emission lines, no mercury is used. Similarly other higher vapor pressure metal halides such as thallium, indium, gallium, and zinc are preferably avoided. Typical metal halide salts are used, and balanced appropriately to obtain the desired chromaticity at the desired operating temperature, and so that chromaticity drift during dimming was minimal. Commonly used metal halide salts are NaI, $DyI_3$, $CeI_3$, $CaI_2$, TlI. The use of thallium-containing salts is allowed, if properly balanced by other metal halide components. Thallium containing salts are allowed if the increase due to the thallium 535 nanometer emission during dimming is balanced by with increases in other emissions from other metals such as Dy and Na. To help with thermal management of the lamp and increase voltage, additional xenon buffer gas is added, with a cold fill pressure of up to several atmospheres ($10^5$ Pascals).

The prescribed fill formulations generally result in less stabile arc positioning, so additional controls may be necessary to position the arc. There are two practical methods that are known in the art. The first is to provide wall stabilization by increasing the lamp's length to diameter aspect ratio. The long narrow tubes tend to hold the arc in a stabile location. Another method is to modulate the input power at a frequency that corresponds to an arc tube cavity resonance mode. The resulting resonant waves in the cavity may then be used to hold the arc in a stabile position.

The replacement of mercury with high pressure xenon may lead to arc instabilities. If necessary, modulation of the power at acoustic resonance frequencies may be used to control the arc position. The acoustic frequencies applied depend on the arc tube cavity geometry and speed of sound distribution of the vapor in the arc tube during operation. For high aspect ratio lamps having cylindrical or near cylindrical (having tapered sides or rounded corners) arc tubes, generally a band of frequencies exciting the second azimuthal or a combination second azimuthal-longitudinal mode is required to straighten and center the arc in the arc tube. These frequencies can be estimated by $$f_{2A}=(3.05*C)/(\pi*D)$$

where C is the average speed of sound for the combined vapor species used in the arc tube and D is the cavity diameter.

For nearly spherical or bulgy type arc tubes (e.g. Sylvania Powerball®), single frequency excitation is adequate for arc straightening during vertical operation, although a wider band of frequencies can be used for robustness or convenience. The bulgy arc tube cavity is not quite spherical, being slightly elongated on the discharge axis. The preferred frequency or band applied to the lamp excites the second azimuthal like mode (if approximating the arc tube cavity as a cylinder) or the mode corresponding to n=0, l=2 (if approximating the arc tube cavity as a sphere). Determination of the preferred frequency depends on the fill components and the lamp shape, but is otherwise considered a normal skill in the art.

Since it is the power frequencies that are essential for exciting the acoustic resonances, the voltage waveform need not be specified. Any of a number of different voltage waveforms, which generates appropriate power frequencies, can be used. Some wave combination examples are (1) a square wave with ripple, such as the sum of DC plus a ripple where the ripple has the desired resonance frequency or band of frequency, the sum being switched in magnitude at frequencies in the 100's of Hz, (2) a sine wave at half the desired acoustic resonance frequency or band of frequencies, (3) the sum of two sine waves, with the sum or difference of the frequencies being equal to a desired acoustic resonance frequency or band of frequencies, (4) an amplitude modulated (AM) high frequency carrier, with the AM at the desired resonance frequency or band of frequencies and the carrier frequency above frequencies where the acoustic waves are dampened but below the practical efficient limits of power electronics in the 300 kHz to 1 MHz range.

The resulting discharge lighting is efficient and has a pleasant white appearance at rated power. In addition, as the power is reduced, the chromaticity of the output either (1) remains fairly constant or (2) drifts acceptably towards warm pinkish colors, which provides a warm ambience similar to incandescent lamps. The lamps may be dimmed to quite low powers, providing a reasonably wide range in lumen output.

SPECIFIC EXAMPLES

Examples of ceramic 70 watt lamps are given. Listed are the arc tube cavity type, arc tube chemical contents, xenon cold fill pressure, example acoustic straightening frequency or band, and the chromaticity drift with dimming is typified as being either (1) a constant type or (2) a pink trending type.

The differing envelope structures were used through the cited examples. The shapes included bulgy, cylindrical and two types of cylindrical with tapered, rounded ends. The envelopes were formed from PCA. The most common form was a bulgy configuration that had an internal volume of 0.369 cubic centimeters. The electrodes had known constructions consisting of niobium outer sections, molybdenum middle sections sealed to the PCA, and tungsten rod inner sections wrapped with tungsten coils.

Lamp BH053

Arc tube was a 70 watt ceramic body with a bulgy shape, approximately spherical, 8 millimeters radial diameter, 10 millimeters axial diameter with an enclosed volume of 0.369 cc (specifically a Sylvania Powerball®). The fill chemistry was 1.80 mg NaI, 0.69 mg CeI3, 1.85 mg DyI3, 0.62 mg $CaI_2$, 0.18 mg TlI. The relative weight percents were: ($NaI:CeI_3:DyI_3:CaI_2:TlI$/35.05:13.41:36.03:12.10:3.42). The total salt concentration was 13.89 mg/cc. The xenon fill pressure was 200 Kilopascals. The applied power was modulated with a frequency of about 64 kHz, corresponding to a resonant frequency of the lamp. The chromaticity drift was the constant type.

Lamp BH054

Arc tube was a 70 watt bulgy, approximately spherical, 8 millimeters radial diameter, 10 millimeters axial diameter with an enclosed volume of 0.369 cubic centimeters. The fill chemistry was 1.82 mg NaI, 0.69 mg $CeI_3$, 1.77 mg $DyI_3$, 0.79 mg $CaI_2$, 0.22 mg TlI. The weight percents were then ($NaI:CeI_3:DyI_3:CaI_2:TlI$/34.33:13.07:33.50:14.94:4.17). The total salt concentration was 14.35 mg/cc. The fill gas was xenon at a pressure of 300 Kilopascals. The applied power was modulated with a frequency of about 64 kHz, corresponding to a resonant frequency of the lamp. The chromaticity drift was the constant type.

Lamp BH055

Arc tube was a 70 watt bulgy, approximately spherical, 8 millimeters radial diameter, 10 millimeters axial diameter with an enclosed volume of 0.369 cubic centimeters. The fill chemistry was 1.84 mg NaI, 0.73 mg $CeI_3$, 1.87 mg $DyI_3$, 0.62 mg $CaI_2$, 0.21 mg TlI. The weight percents were then ($NaI:CeI_3:DyI_3:CaI_2:TlI$/34.98:13.78:35.53:11.78:3.93). The total salt concentration was 14.26 mg/cc. The lamp fill had a xenon pressure of about 400 Kilopascals. The applied power was modulated with a frequency of about 64 kHz, corresponding to a resonant frequency of the lamp. The chromaticity drift was the constant type.

Lamp BH056

Arc tube was a 70 watt bulgy, approximately spherical, 8 millimeters radial diameter, 10 millimeters axial diameter with an enclosed volume of 0.369 cubic centimeters. The fill chemistry was 1.81 mg NaI, 0.75 mg $CeI_3$, 1.80 mg $DyI_3$, 0.62 mg $CaI_2$, 0.19 mg TlI. The weight percents were then ($NaI:CeI_3:DyI_3:CaI_2:TlI$/34.97:14.53:34.80:11.98:3.71). The total salt concentration was 14.02 mg/cc. The fill gas was xenon at a pressure of 500 Kilopascals. The applied power was modulated with a frequency of about 64 kHz, corresponding to a resonant frequency of the lamp. The chromaticity drift was the constant type.

Lamp BC030

Arc tube was a 70 watt bulgy, approximately spherical, 8 millimeters radial diameter, 10 millimeters axial diameter with an enclosed volume of 0.369 cubic centimeters. The fill chemistry was 3.08 mg NaI, 1.76 mg $CeI_3$, and 5.25 mg $DyI_3$. The weight percents were then ($NaI:CeI_3:DyI_3$/30.50:17.44:52.06). The total salt concentration was 27.34 mg/cc. The fill gas was xenon at a pressure of 100 Kilopascals. The lamp was operated with a modulated input power with straightening frequencies sweeping from about 57 k to about 67 kHz. The chromaticity drift was the pink trending type.

Lamp BC031

Arc tube was a 70 watt bulgy, approximately spherical, 8 millimeters radial diameter, 10 millimeters axial diameter with an enclosed volume of 0.369 cubic centimeters. The fill chemistry was 3.04 mg NaI, 1.77 mg $CeI_3$, and 5.25 mg $DyI_3$. The weight percents were then ($NaI:CeI_3:DyI_3$/30.19:17.59:52.22). The total salt concentration was 27.26 mg/cc. The fill gas was xenon at a pressure of 200 Kilopascals. The lamp operated with a modulated input power with a frequency of about 62 kHz, corresponding to an acoustic resonance of the cavity. The chromaticity drift was the pink trending type.

Lamp BC032

Arc tube was a 70 watt bulgy, approximately spherical, 8 millimeters radial diameter, 10 millimeters axial diameter with an enclosed volume of 0.369 cubic centimeters. The fill chemistry was 3.08 mg NaI, 1.73 mg $CeI_3$, and 5.27 mg $DyI_3$. The weight percents were then ($NaI:CeI_3:DyI_3$/30.56:17.16:52.28). The total salt concentration was 27.32 mg/cc. The fill gas was xenon at a pressure of 300 Kilopascals. The lamp operated with a modulated input power with a frequency of about 62 kHz, corresponding to an acoustic resonance of the cavity. The chromaticity drift was the pink trending type.

Lamp JC016

Arc tube had a cavity approximately cylindrical with spherical end bells, 3.7 millimeters diameter at the center, tapering slightly towards the ends, 23 millimeters inner length giving a total volume of about 0.19 cubic centimeters. The fill chemistry was 3.11 mg NaI, 1.77 mg $CeI_3$, and 5.26 mg $DyI_3$. The weight percents were then ($NaI:CeI_3:DyI_3$/30.66:17.46:51.89). The total salt concentration was 53.37 mg/cc. The fill gas was xenon at a pressure of 200 Kilopascals. The lamp was operated with modulated input power with frequencies in the range of about 130-150 kHz, corresponding to an acoustic resonance of the cavity. The chromaticity drift was the pink trending type.

Lamp JF045

Arc tube had a cavity that was approximately cylindrical with spherical end bells, 3.7 millimeters diameter at the center, tapering slightly towards the ends, 23 millimeters inner length. The fill chemistry was 3.09 mg NaI, 1.15 mg $CeI_3$, 3.52 mg $DyI_3$, 0.29 mg TlI. The weight percents were then ($NaI:CeI_3:DyI_3:TlI$/38.40:14.29:43.71:3.60). The total salt concentration was 42.37 mg/cc. The lamp was operated with modulated input power with frequencies in the range of about 130-150 kHz, corresponding to an acoustic resonance of the cavity. The chromaticity drift was the constant type.

Lamp JG046

Arc tube had a cavity that was approximately cylindrical with spherical end bells, 3.7 millimeters diameter at the center, tapering slightly towards the ends, 23 millimeters inner length. The fill chemistry was 2.78 mg NaI, 1.48 mg $CeI_3$, 2.92 mg $DyI_3$, 1.15 mg $CaI_2$. The weight percents were then ($NaI:CeI_3:DyI_3:CaI_2$/33.35:17.79:35.04:13.82). The total salt concentration was 43.79 mg/cc. The fill gas was xenon at a pressure of 200 Kilopascals. The lamp was operated with modulated input power with frequencies in the range of about 130-150 kHz, corresponding to an acoustic resonance of the cavity. The chromaticity drift was the pink trending type.

Lamp JH047

The arc tube had a cavity approximately cylindrical with spherical end bells, 3.7 millimeters diameter at the center, tapering slightly towards the ends, 23 millimeters inner length. The fill chemistry was 2.76 mg NaI, 1.24 mg $CeI_3$, 2.81 mg $DyI_3$, 1.08 mg $CaI_2$, 0.35 mg TlI. The weight percents were then (NaI:$CeI_3$:$DyI_3$:$CaI_2$:TlI/33.45:15.05:34.14:13.11:4.25). The total salt concentration was 43.37 mg/cc. The fill gas was xenon at a pressure of 200 Kilopascals. The lamp was operated with modulated input power with frequencies in the range of about 130-150 kHz, corresponding to an acoustic resonance of the cavity. The chromaticity drift was the constant type.

Lamp XC024

The arc tube had a cavity that was approximately cylindrical with hemispherical ends, 5.2 millimeters diameter at the center, tapering slightly towards the ends, a 15 millimeter inner length with an enclosed volume of 0.242 cubic centimeters. The fill chemistry was 3.08 mg NaI, 1.82 mg $CeI_3$, and 5.27 mg $DyI_3$. The weight percents were then (NaI:$CeI_3$:$DyI_3$/30.29:17.90:51.82). The total salt concentration was 42.02 mg/cc. The fill gas was xenon at a pressure of 100 Kilopascals. The lamp was operated with modulated input power with frequencies in the range of about 95-115 kHz, corresponding to an acoustic resonance of the cavity. The chromaticity drift was the pink trending type.

Lamp XC025

The arc tube had a cavity approximately cylindrical with spherical end bells, 5.2 millimeters diameter at the center, tapering slightly towards the ends, 15 millimeters inner length. The fill chemistry was 3.10 mg NaI, 1.73 mg $CeI_3$, and 5.19 mg $DyI_3$. The weight percents were then (NaI:$CeI_3$:$DyI_3$/30.92:17.28:51.80). The total salt concentration was 41.36 mg/cc. The fill gas was xenon at a pressure of 200 Kilopascals. The lamp was operated with modulated input power with frequencies in the range of about 95-115 kHz, corresponding to an acoustic resonance of the cavity. The chromaticity drift was the pink trending type.

Lamp XC026

The arc tube had a cavity that was approximately cylindrical with spherical end bells, 5.2 millimeters diameter at the center, tapering slightly towards the ends, 15 millimeters inner length. The fill chemistry was 3.09 mg NaI, 1.79 mg $CeI_3$, and 5.25 mg $DyI_3$. The weight percents were then (NaI:$CeI_3$:$DyI_3$/30.49:17.69:51.82). The total salt concentration was 41.82 mg/cc. The fill gas was xenon at a pressure of 300 Kilopascals. The lamp was operated with modulated input power with frequencies in the range of about 95-115 kHz, corresponding to an acoustic resonance of the cavity. The chromaticity drift was the pink trending type.

Lamp XH057

The arc tube had a cavity that was approximately cylindrical with spherical end bells, 5.2 millimeters diameter at the center, tapering slightly towards the ends, 15 millimeters inner length. The fill chemistry was 1.89 mg NaI, 0.66 mg $CeI_3$, 1.80 mg $DyI_3$, 0.63 mg $CaI_2$, 0.18 mg TlI. The weight percents were then (NaI:$CeI_3$:$DyI_3$:$CaI_2$:TlI/36.59:12.80:34.87:12.20:3.54). The total salt concentration was 21.34 mg/cc. The fill gas was xenon at a pressure of 200 Kilopascals. The lamp was operated with modulated input power with frequencies in the range of about 95-115 kHz, corresponding to an acoustic resonance of the cavity. The chromaticity drift was the constant type.

Lamp XH058

The arc tube had a cavity that was approximately cylindrical with spherical end bells, 5.2 millimeters diameter at the center, tapering slightly towards the ends, 15 millimeters inner length. The fill chemistry was 1.86 mg NaI, 0.74 mg $CeI_3$, 1.89 mg $DyI_3$, 0.60 mg $CaI_2$, 0.22 mg TlI. The weight percents were then (NaI:$CeI_3$:$DyI_3$:$CaI_2$:TlI/34.98:13.95:35.61:11.31:4.15). The total salt concentration was 21.92 mg/cc. The fill gas was xenon at a pressure of 300 Kilopascals. The lamp was operated with modulated input power with frequencies in the range of about 95-115 kHz, corresponding to an acoustic resonance of the cavity. The chromaticity drift was the constant type.

Lamp XH059

The arc tube had a cavity that was approximately cylindrical with spherical end bells, 5.2 millimeters diameter at the center, tapering slightly towards the ends, 15 millimeters inner length. The fill chemistry was 1.83 mg NaI, 0.72 mg $CeI_3$, 1.79 mg $DyI_3$, 0.80 mg $CaI_2$, 0.18 mg TlI. The weight percents were then (NaI:$CeI_3$:$DyI_3$:$CaI_2$:TlI/34.36:13.52:33.70:15.02:3.40). The total salt concentration was 22 mg/cc. The fill gas was xenon at a pressure of 400 Kilopascals. The lamp was operated with modulated input power with frequencies in the range of about 110-120 kHz, corresponding to an acoustic resonance of the cavity. The chromaticity drift was the constant type.

Lamp CC5

The arc tube had a cavity that was cylindrical, 3.2 millimeters inside diameter, 25.6 millimeters inner length, with an enclosed volume of 0.206 cubic centimeters. The fill chemistry was 2.99 mg NaI, 1.81 mg $CeI_3$, 5.19 mg $DyI_3$. The weight percents were then (NaI:$CeI_3$:$DyI_3$/29.91:18.14:51.95). The salt concentration was 48.45 mg/cc. The fill gas was xenon at a pressure of 200 Kilopascals. The lamp was operated with modulated input power with frequencies in the range of about 145-165 kHz, corresponding to an acoustic resonance of the cavity. The chromaticity drift was the pink trending type.

Lamp BL119

The arc tube had a cavity that was bulgy, approximately spherical, with an 8 millimeter radial diameter and a 10 millimeter axial diameter. The envelope had an enclosed volume of 0.369 cubic centimeters. The fill chemistry was 1.988 mg NaI, 1.97 mg $DyI_3$. 1.007 mg $TmI_3$, 2.211 mg $CaI_2$ and 0.845 mg TlI. The weight percents were then (NaI:$DyI_3$:$CaI_2$:TlI:TmI/24.68:24.61:27.59:10.55:12.57). The salt concentration was 21.72 mg/cc. The fill gas was xenon at a pressure of 50 Kilopascals. The lamp was operated with modulated input power with a sweeping frequency in the range of about 57-67 kHz, corresponding to an acoustic resonance of the cavity. The chromaticity drift was the constant type.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An arc discharge lamp comprising:

a light transmissive envelope formed from ceramic, the envelope having a wall defining an enclosed volume;

a first electrode assembly extending from the lamp exterior through the wall in a sealed fashion to be in contact with the enclosed volume;

a second electrode assembly extending from the lamp exterior through the wall in a sealed fashion to be in contact with the enclosed volume;

a xenon fill gas in the enclosed volume with a cold fill pressure from 100 Kilopascals to 500 Kilopascals;

a fill material including NaI with a weight percent from 29.91 to 38.40, $CeI_3$ with a weight percent from 12.80 to 18.14, $DyI_3$ with a weight percent from 33.50 to 52.28, $CaI_2$ with a weight percent from 11.31 to 15.02 and TlI with a weight percent from 3.49 to 4.25; and wherein the fill material does not include mercury, indium, gallium, or zinc or compounds including these elements.

2. The arc discharge lamp of claim 1, wherein the fill material has a concentration with respect to the enclosed volume ranging from 13.89 to 53.37 mg/cc.

3. An arc discharge lamp comprising:

a light transmissive envelope formed from polycrystalline alumina (PCA), the envelope having a wall defining an enclosed volume;

a first electrode assembly extending from the lamp exterior through the wall in a sealed fashion to be in contact with the enclosed volume;

a second electrode assembly extending from the lamp exterior through the wall in a sealed fashion to be in contact with the enclosed volume;

a xenon fill gas in the enclosed volume with a cold fill pressure from 200 Kilopascals to 500 Kilopascals; and a fill material including NaI with a weight percent from 33.45 to 36.59, $CeI_3$ with a weight percent from 12.80 to 15.05, $DyI_3$ with a weight percent from 33.50 to 36.03, $CaI_2$ with a weight percent from 11.31 to 15.02 and TlI with a weight percent from 3.4 to 4.25.

4. The arc discharge lamp of claim 3, wherein the fill material has a concentration with respect to the enclosed volume ranging from 13.89 to 43.37 mg/cc.

5. An arc discharge lamp comprising: a light transmissive envelope formed from polycrystalline alumina (PCA), the envelope having a wall defining an enclosed volume; a first electrode assembly extending from the lamp exterior through the wall in a sealed fashion to be in contact with the enclosed volume;

a second electrode assembly extending from the lamp exterior through the wall in a sealed fashion to be in contact with the enclosed volume; a xenon fill gas in the enclosed volume with a cold fill pressure from 100 Kilopascals to 300 Kilopascals;

a fill material including NaI with a weight percent from 29.91 to 30.92, $CeI_3$ with a weight percent from 17.16 to 18.14, and $DyI_3$ with a weight percent from 51.80 to 52.28; and wherein the fill material does not include mercury, indium, gallium, or zinc or compounds including these elements.

6. The arc discharge lamp of claim 5, wherein the fill material has a concentration with respect to the enclosed volume ranging from 27.26 to 53.37 mg/cc.

7. An arc discharge lamp comprising:

a light transmissive envelope formed from ceramic, the envelope having a wall defining an enclosed volume;

a first electrode assembly extending from the lamp exterior through the wall in a sealed fashion to be in contact with the enclosed volume;

a second electrode assembly extending from the lamp exterior through the wall in a sealed fashion to be in contact with the enclosed volume;

a xenon fill gas in the enclosed volume with a cold fill pressure from 50 Kilopascals to 500 Kilopascals;

a fill material including NaI with a weight percent from 24.68 to 38.40, $CeI_3$ with a weight percent from 0.00 to 18.14, $DyI_3$ with a weight percent from 24.61 to 52.28, $CaI_2$ with a weight percent from 11.31 to 27.59, TlI with a weight percent from 3.49 to 10.55; and $TmI_3$ with a weight percent from 0.00 to 12.57; and wherein the fill material does not include mercury, indium, gallium, or zinc or compounds including these elements.

8. The arc discharge lamp of claim 7, wherein the fill material has a concentration with respect to the enclosed volume ranging from 13.89 to 53.37 mg/cc.

* * * * *